US009422078B2

(12) United States Patent
Koch

(10) Patent No.: US 9,422,078 B2
(45) Date of Patent: Aug. 23, 2016

(54) TRANSPORT PACKAGING

(71) Applicant: Storopack Hans Reichenecker GmbH, Metzingen (DE)

(72) Inventor: Joerg Koch, Wolfersheim (DE)

(73) Assignee: Storopack Hans Reichenecker GMBH, Metzingen (DE)

( * ) Notice: Subject to any disclaimer, the term of this patent is extended or adjusted under 35 U.S.C. 154(b) by 0 days.

(21) Appl. No.: 14/317,941

(22) Filed: Jun. 27, 2014

(65) Prior Publication Data

US 2015/0033680 A1 Feb. 5, 2015

(30) Foreign Application Priority Data

Aug. 5, 2013 (DE) ..... 10 2013 215 328

(51) Int. Cl.

| | |
|---|---|
| ***B65D 73/00*** | (2006.01) |
| ***B65D 5/50*** | (2006.01) |
| ***B65B 7/28*** | (2006.01) |
| ***B65B 11/58*** | (2006.01) |
| ***B65D 25/10*** | (2006.01) |

(52) U.S. Cl.

CPC ..... *B65D 5/5028* (2013.01); *B65B 7/28* (2013.01); *B65B 11/58* (2013.01); *B65D 5/5021* (2013.01); *B65D 25/102* (2013.01)

(58) Field of Classification Search

CPC ..... B65D 5/5028; B65B 7/28; B65B 11/58
USPC ..... 206/477, 478, 483, 488, 489, 521, 206/591–594; 229/125.22, 125.38; 248/499, 500

See application file for complete search history.

(56) References Cited

U.S. PATENT DOCUMENTS

| | | | | |
|---|---|---|---|---|
| 1,842,034 | A * | 1/1932 | Lewis | 206/583 |
| 3,159,275 | A | 12/1964 | Antwerpen et al. | |
| 3,421,679 | A * | 1/1969 | Goldman | 206/523 |
| 4,158,410 | A * | 6/1979 | Novatny | 206/451 |
| 4,307,805 | A * | 12/1981 | Welch et al. | 206/586 |
| 4,865,200 | A * | 9/1989 | Sullivan et al. | 206/594 |
| 4,909,385 | A | 3/1990 | Blymiller | |
| 5,549,202 | A * | 8/1996 | Whiteside | 206/526 |
| 5,718,369 | A * | 2/1998 | Delisle et al. | 229/125.38 |

(Continued)

FOREIGN PATENT DOCUMENTS

| | | |
|---|---|---|
| CN | 86 100 982 A | 9/1986 |
| DE | 9111941 | 1/1992 |

(Continued)

OTHER PUBLICATIONS

Search Report, German Application No. 10 2013 215 328.7, Sep. 20, 2013, 4 pages.

European Patent Office Search Report, corresponding EP Application No. 35020677EP, Nov. 13, 2014.

*Primary Examiner* — Luan K Bui

(74) *Attorney, Agent, or Firm* — Wood, Herron & Evans, LLP

(57) ABSTRACT

A transport packaging (100) for transporting an object (24) comprises a container (10) that is open at least at first on one side and has a bottom (12) and at least two opposing sidewalls (14). It is suggested that the two opposing sidewalk (14) have at least one material weakening (20) starting from the free end (18), and that the transport packaging (100) comprises a tightening strap (28) that is tightened around the container (10) in the area of the material weakening (20) and penetrates the sidewall (14) in the area of the material weakening (20).

7 Claims, 5 Drawing Sheets

(56) References Cited

U.S. PATENT DOCUMENTS

| | | | | |
|---|---|---|---|---|
| 5,897,051 | A * | 4/1999 | Tessier et al. | 229/125.38 |
| 6,158,589 | A * | 12/2000 | Smith et al. | 206/591 |
| 6,206,184 | B1 | 3/2001 | Goguen et al. | |
| 6,817,472 | B1 * | 11/2004 | Williams | 206/521 |
| 8,474,618 | B2 * | 7/2013 | McDowell | 206/451 |
| 2008/0264819 | A1 | 10/2008 | McDowell | |

FOREIGN PATENT DOCUMENTS

| | | | |
|---|---|---|---|
| DE | 29912211 | | 1/2005 |
| DE | 102006003318 | | 8/2007 |
| EP | 0 320 634 | A1 | 6/1989 |
| EP | 1810930 | | 7/2007 |
| JP | 2006 137459 | A | 6/2006 |

* cited by examiner

TRANSPORT PACKAGING

The present invention relates to a transport packaging and to a container for such a transport packaging.

Transport packagings are packagings that make it possible to transport objects and protect the objects during the transport as well as possible from damage. The transport packagings should be as inexpensive as possible. The transport packagings must be easy to handle and make possible a simple and reliable packaging of the matter to be sent.

Such transport packagings are frequently manufactured from stabilized paper types (pasteboard or in combination with cardboard or corrugated cardboard). The transport packagings are manufactured for different shipping material in different strengths and sizes. In order that they require as little space in a warehouse, they can usually be folded together. Parallelepipedic and open-at-the-top containers of pasteboard are known into which the objects to be transported are placed. The remaining empty space is filled up, for example, with filling material. The container is then closed with a cover.

U.S. Pat. No. 6,206,184 B1, e.g., shows a transport packaging in which shipping material is fixed in the transport packaging by a tightening strap. To this end the tightening strap runs over the shipping material partially outside of the transport packaging and is guided in two V-shaped opposing slots provided in the side wall of a container of the transport packaging.

The invention has the problem of creating a transport packaging that is especially simple to handle and in which the shipping material can be simply and reliably fixed. The cost for the transport packaging should remain low.

This problem is solved by a transport packaging with the features of the present invention. Advantageous further developments of the invention are cited in the subclaims.

The material weakening constitutes a theoretical separation seam in the sidewall of the container and runs from the free edge or from the upper edge of the sidewall in the direction of the bottom of the container. The theoretical separation seam is then pressed in during the tightening of the tightening strap so that a slot is produced and the tightening strap can penetrate into the interior of the container and fix objects present there. The material weakening is pressed in only over such a length as is necessary for fixing the object. The integrity of the container is therefore preserved as well as possible so that the object remains protected as well as possible. The material weakening can be realized in a very simple manner and therefore economically in a manufacturing process. In contrast to a slot that is already present in advance, it has the advantage that the container remains completely intact—without tightening strap—and can therefore be used even without a tightening strap if necessary without an undesired opening present in the sidewall of the container. Moreover, as already mentioned, the material weakening is pressed in only as is necessary by the tightening strap so that even in this case an unnecessarily large opening in the sidewall is avoided. The strapping of the container can furthermore take place automatically without an additional step for introducing a slot being required. Furthermore, the invention has the advantage that the container, in particular its s dewalls, is a stable pasteboard box when being packed with objects that can therefore be filled with objects in an especially problem-free manner.

In a preferred embodiment of the transport packaging according to the invention it is provided that the material weakening has a perforation. Such a perforation can be produced readily and economically on customary stamping machines. Moreover, a material weakening in the form of a tear perforation can be especially readily torn open by a tightening strap of the transport packaging. For example, after the packing of the container the tightening strap is placed around the entire circumference of the container in the area of the tear perforation and then drawn tight, during which the tightening strap separates the tear perforation but only until the tightening strap has reached the surface of the object present in the container. In this manner the object in the surrounding packaging is reliably fixed in a simple manner without additional filling material having to be used.

Of course, at least a part of the unused volume in the container can also be used, e.g., for inserting a support padding for transporting a sensitive, in particular pressure-sensitive object. A padding can also be used that completely surrounds the object.

Furthermore, it is advantageous if at least a pair of two parallel material weakenings are formed in the opposing sidewalls between which weakenings a flap is formed that can be pressed in at least partially by the tightening strap. Such a flap that can be folded into the interior of the container prevents the tightening strap from directly contacting the object to be transported and therefore serves as an "intermediate layer" or "padding" protecting the object. The flap is preferably designed to be somewhat larger than the width of the tightening strap.

It is also suggested that the material weakenings extend, starting from the free edge, over a length of approximately ⅔ of the height of the sidewalls. However, an actual length of the material weakening can also deviate from this or can vary within a certain frame and is adapted to a use or an application of the container. This represents a good compromise between a good stability of the container and a sufficient fixing even of flat objects in the container.

Another further development is distinguished in that at least two areas with at least one material weakening are provided per sidewall so that two tightening straps that are spaced from one another can be attached. To this extent in order to pack the object or the objects preferably two tightening straps are provided; however, the number of tightening straps is in principle as desired. This embodiment also has, in addition to the simple handling, the further advantage that transport packagings only have to be stored in rough dimensional differences. Although the transport packaging is perhaps too large for a certain object, it is ensured that the object can be reliably stored in the transport packaging.

The tightening strap is preferably manufactured from tear-resistant plastic, e.g., polypropylene (PP) or polyethylene terephthalate (PET).

Furthermore, an area of the material weakening directly adjacent to the free edge can run at an angle of approximately 45° to the free edge. This facilitates the penetration of the tightening strap into the material weakening and prevents a tearing out of the free edge of the container.

Furthermore, it is provided for the transport packaging of the invention that the object can be covered with a cover plate before the fixing with the tightening strap and that the cover plate has not quite the size of the bottom surface of the container and is manufactured from a flexible and shock-absorbing material. In the simplest and most economical case the cover plate is manufactured from the same material as the container, that is, for example, pasteboard. The cover plate significantly increases the protection of the objects to be transported, especially if several objects are to be transported in the container. They can be held together in an overlapping manner by the cover plate, and the active area of the tightening strap is distributed onto a greater surface. Even rather small individual parts are held without problems under the cover plate and cannot fall out, e.g., during a tilting of the entire transport packaging during transportation. If required, empty spaces in the container can be filled out with any filling material for an even greater protection of the shipping material.

Furthermore, it is provided for the transport packaging that it comprises a parallelepipedic cover open on one side. The cover is intended to serve as a closing cover of the container in order that a shipping of the transport packaging together with its contents can be carried out in a proper manner, e.g., as a package by any shipping company. The cover element is preferably constructed in such a manner that the material weakening of the container is covered. This avoids openings on the transport packaging through which the transport packaging can be damaged during a gripping. A filling out of a free space directly underneath the cover element with filling material can be eliminated since the shipping material is securely fixed by the tightening strap.

Other advantages result from the following description and the attached figures.

Of course, the previously cited features and those that are still to be explained in the following can be used not only in the particular indicated combination but also in other combinations or by themselves without departing from the scope of the present invention.

Exemplary embodiments of the invention are shown in the figures and explained in detail in the following specification. In the schematic figures.

Figure 1:
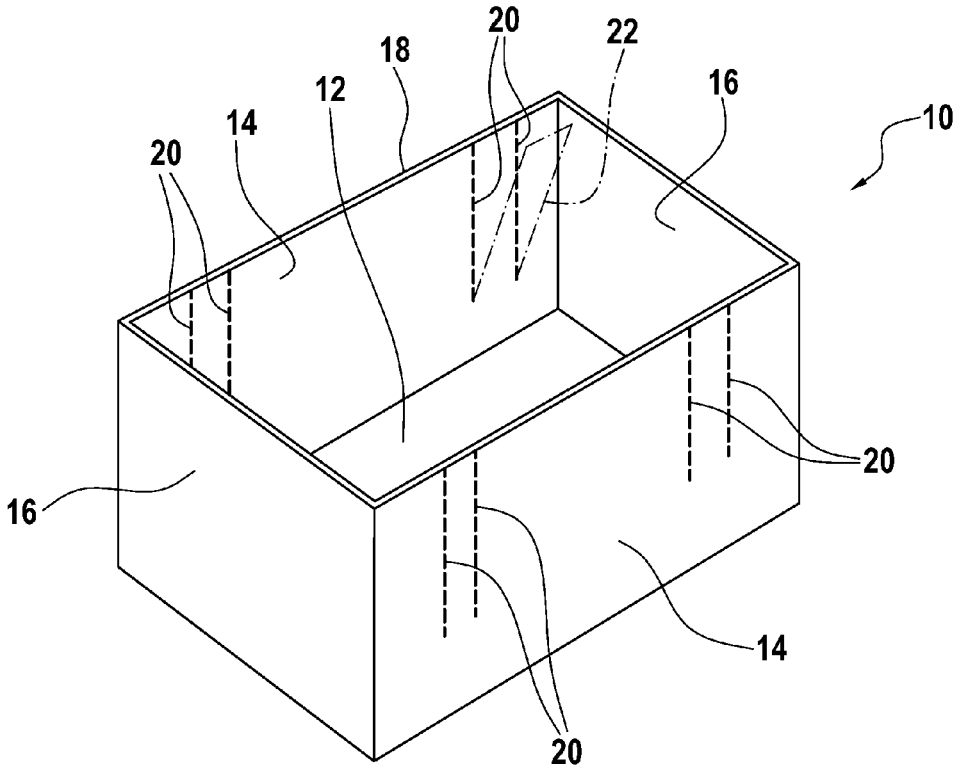
FIG. 1 shows a surrounding packaging of a transport packaging in accordance with the invention.

FIG. 1 shows a preferred embodiment of a container 10 as part of a transport packaging 100. The container 10 is substantially a parallelepipedic pasteboard box of pressed or otherwise stabilized paper or cardboard or corrugated cardboard that is open at the top in FIG. 1. The container 10 therefore has a bottom 12 that is rectangular in a top view, two opposing sidewalls 14 and two opposing front walls 16. The sidewalls 14 each have two material weakenings that are arranged off-center in the form of tear perforations 20, that run from a free upper edge 18 of the sidewall 14 vertically and parallel to one another over a length of approximately one half or two thirds of the height of the sidewalls 14 to the bottom 12.

Therefore, the tear perforations 20 end at a certain distance from the bottom surface 12. The tear perforations 20 all have the same length and constitute a theoretical separating seam in sidewalls 14. Each two tear perforations 20 that are located close together form a pair, whereby after a tearing of the tear perforation 20 of a pair a flap 22 is formed that, e.g., can be bent into the inner space of the containers 10. Of course, the tear perforations 20 can also be arranged in such a manner on the sidewall 14 that only a single flap 22 or more than two flaps 22 can form (not shown).

In the same manner pairs of tear perforations can also be provided in the front walls 16 (not shown).

In a simple embodiment that is not shown the container 10 can also have only a single tear perforation 20 or two tear perforations arranged apart from one another and off-center on two opposing sidewalls 14 or 16. However in this case no foldable flap can be formed.

Figure 2:
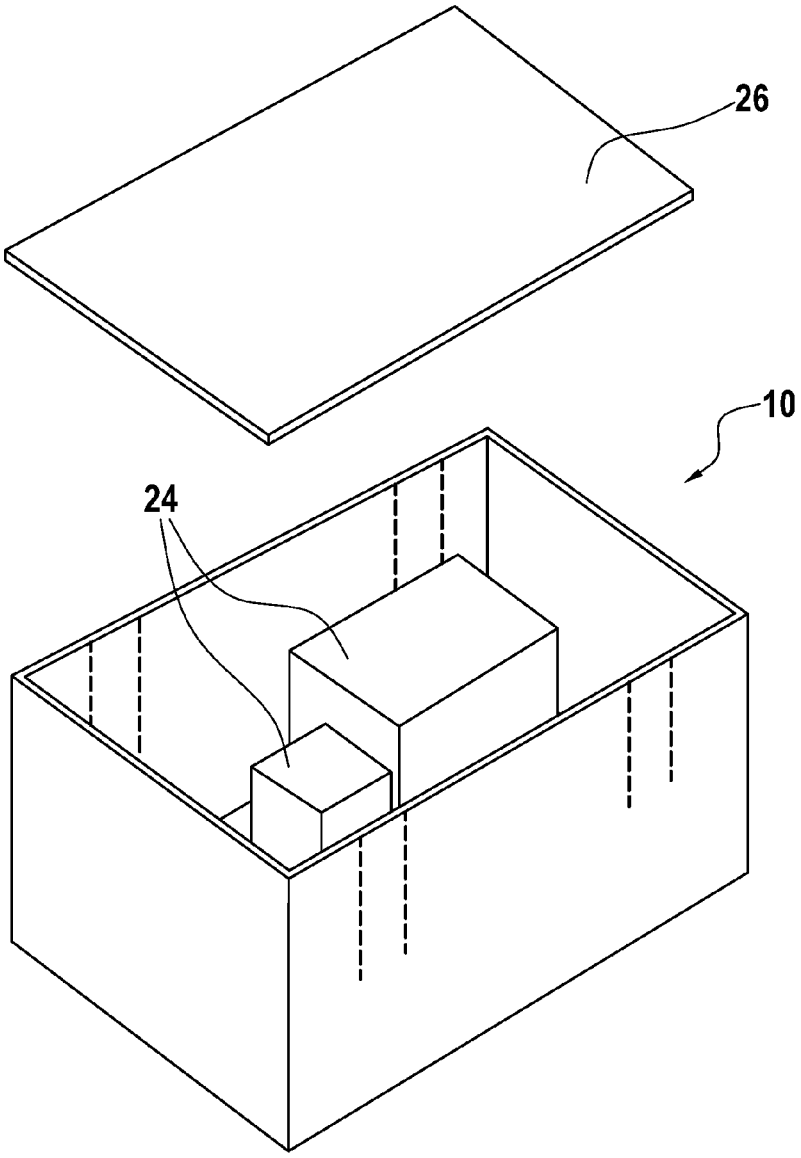
FIG. 2 shows the surrounding packaging of FIG. 1 with shipping material and a provided cover plate.

In FIG. 2 the container 10 comprises transport material in the form of several objects 24 that were set or placed in the container 10 for transport. The transport material 24 is multipartite but can also be only one individual part. In order to protect the transport material 24 during the shipping, the transport packaging 100 has a cover plate 26 that can be placed on the transport material 24. The using of the cover plate 26 is an alternative and can be eliminated, e.g., in the case of only one single object 24 to be packaged. The cover plate 26 is preferably manufactured from a flexible and shock-absorbing material, in the simplest case from the same material as the cover 10. The cover plate 26 is preferably slightly smaller than the bottom 12 of the container 10. For an even better protection during the transport the transport material 24 can be additionally secured with a flexible, filling material in the container 10.

Figure 3:
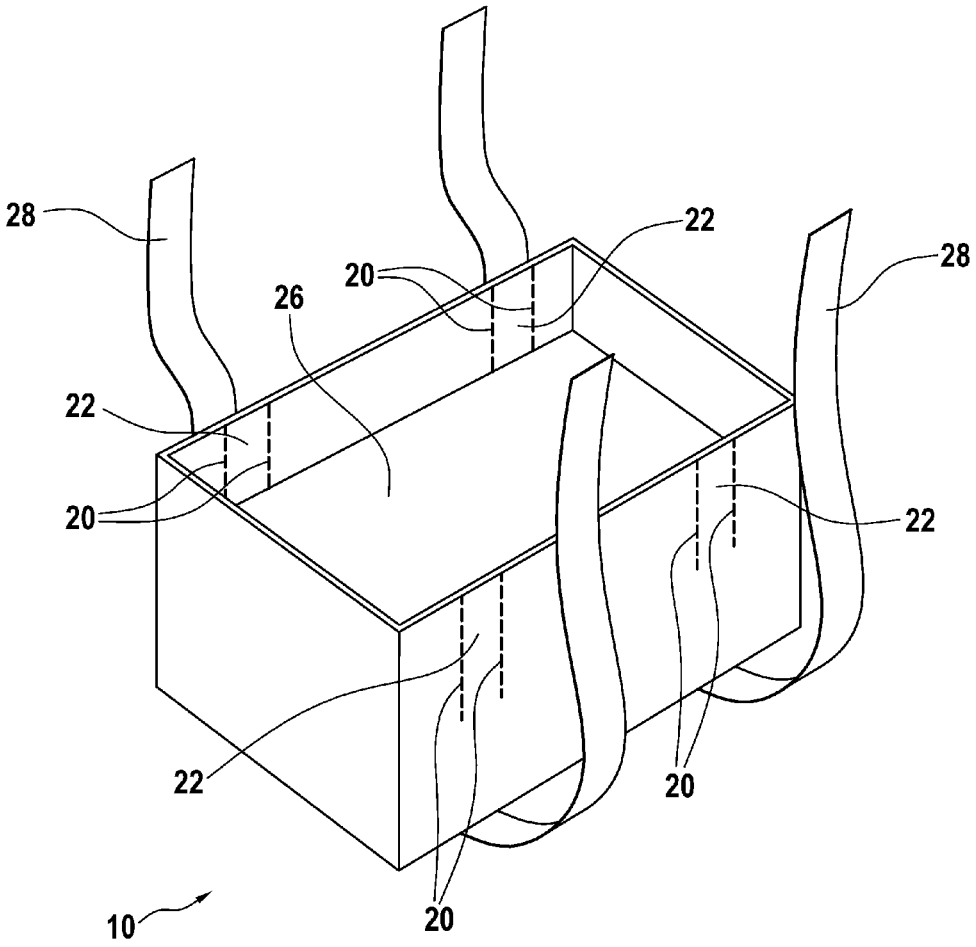
FIG. 3 shows the surrounding packaging of FIG. 2 with two tightening straps provided for fixing the shipping material.

FIG. 3 shows the container 10 with the cover plate 26 covering the transport material 24. In addition, two tightening straps 28 are provided for packaging that are placed in the vertical direction around the container 10 in the area of the provided flaps 22. Therefore, the width of the flaps 22 is preferably somewhat wider than the width of the tightening strap 28. The tightening strap 28 is preferably manufactured from tear-resistant plastic, e.g., from polypropylene (PP) or polyethylene terephthalate (PET).

Figure 4:
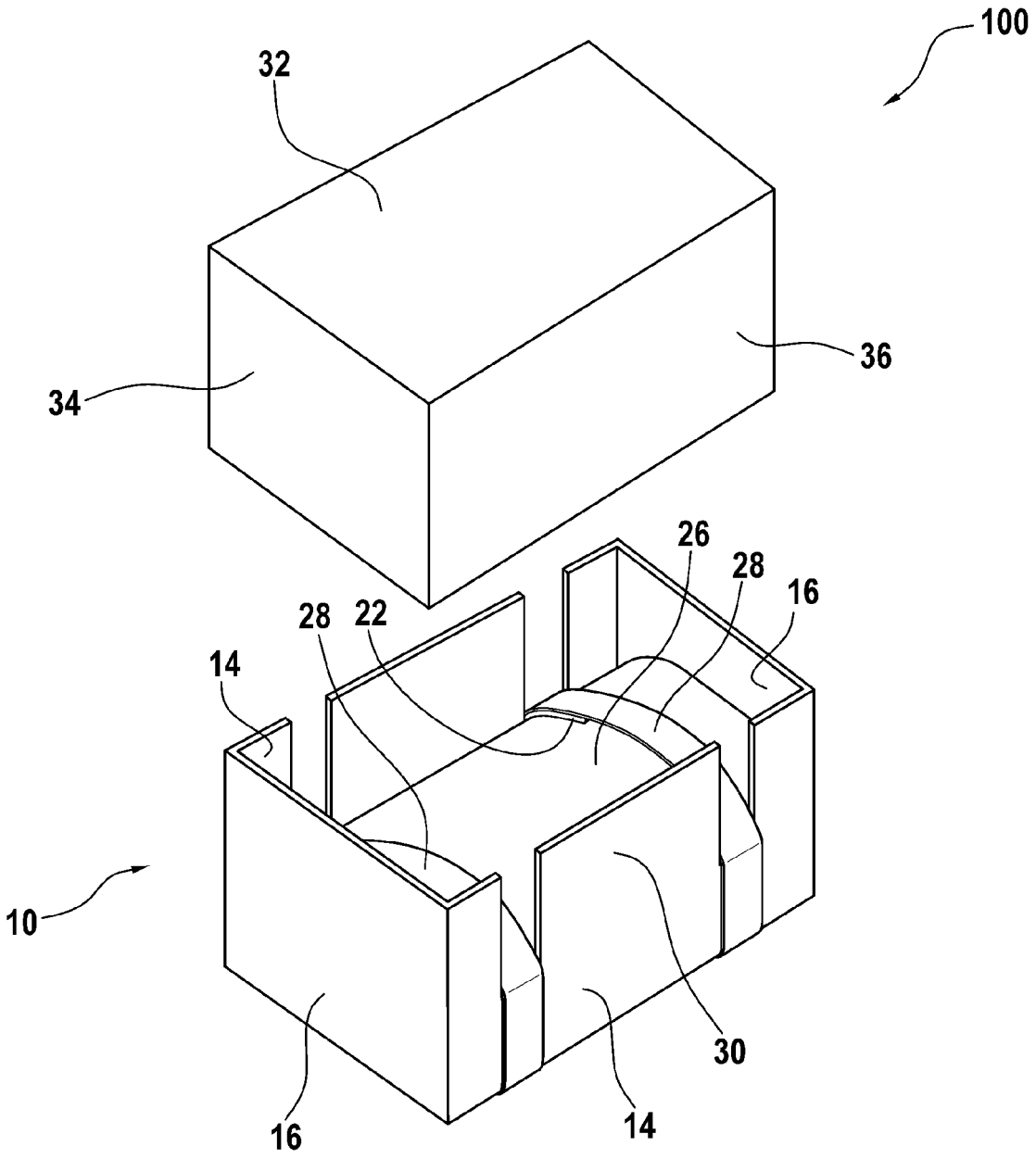
FIG. 4 shows the surrounding packaging of FIG. 3 with two tightened tightening straps.

In FIG. 4 the two tightening straps 28 are tightened together to a ring in that the ends are fixed to one another, e.g., with a closure casing (not visible) provided for this. The tightening straps 28 are firmly pulled together and automatically separate the tear perforations 20 provided on the sidewall 14 when they are pulled together. In order that the tightening strap 28 readily grips in the area of the flap 22, e.g., the flap 22 can be slightly shortened on the top and/or a slope can be provided (not shown) in the area of the tear perforations 20 on the upper end. During the pulling together the tightening strap 28 separates the side wall 14 at the tear perforations 20 only until the tightening strap 28 has reached the surface of the cover plate 26, during which the flaps 22 are bent and thus lie inside the container 10 between the tightening straps 28 and the cover plate 26. The flaps 22 can function as an additional padding. The firmly tightened tightening straps 28 fix the transport material 24 located under the cover plate 26 so that a more secure and orderly transport of the transport material 24 is possible.

In a simple exemplary embodiment in which no bendable flaps are provided, the tightening strap 28 separates the tear perforation 20. The flexible material of the sidewall is possibly slightly damaged at this time; however, the basic properties of the container 10 remain.

For the subsequent transport the container 10 is closed with a cover 32. The cover 32 is preferably a parallelepipedic pasteboard box consisting of pressed paper or cardboard or corrugated cardboard that is open on one side. The cover 32 is dimensioned in such a manner that it can cover the container 10 with its sidewalls 34 and 36. It is therefore set from above onto the container 10 until the free edge 18 of the sidewalls and front walls 14 and 16 rests on the cover 32.

Figure 5:
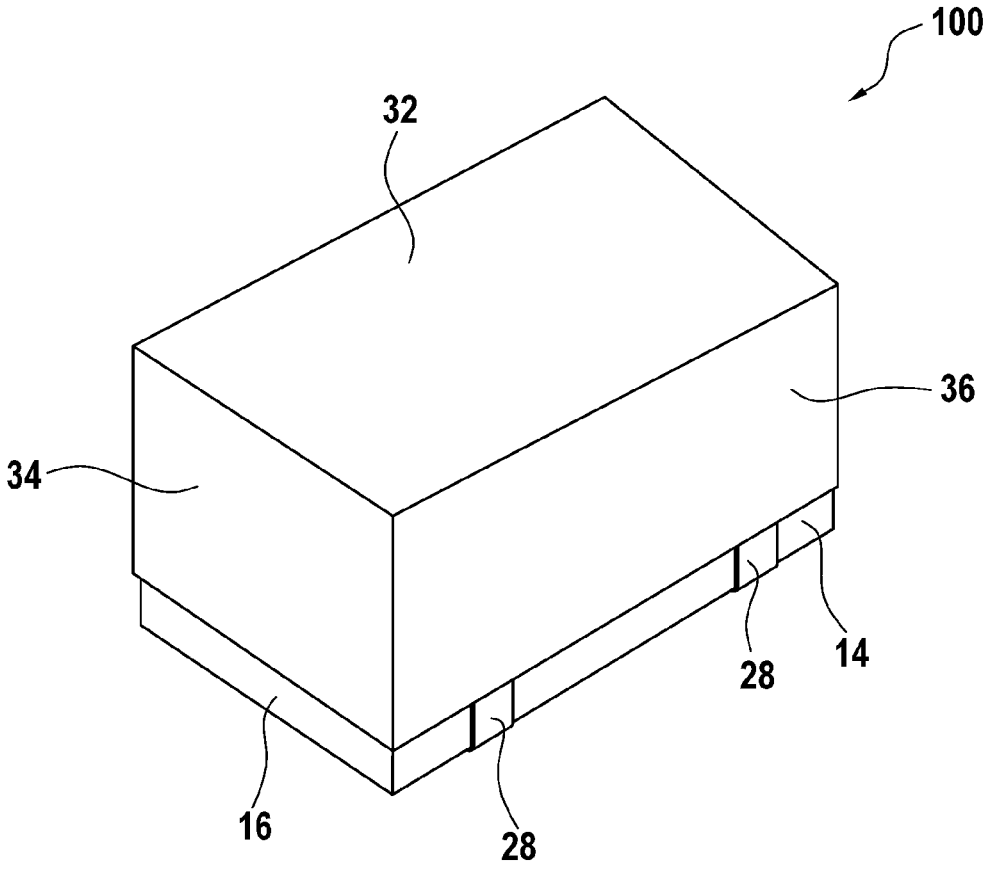
FIG. 5 shows the surrounding packaging of FIG. 4 with a cover element as a complete transport packaging.

FIG. 5 shows the complete transport packaging 100 ready for shipping. The container 10 is closed by the cover 32. The sidewalls 34 and 36 of the cover 32 cover as a safety measure the slots formed by the torn tear perforations 20 of the container 10. The transport packaging 100 is therefore completely closed on all sides. The cover 32 can be fastened on the container 10 by other tightening straps or adhesive strips.

The invention claimed is:

1. A transport packaging for transporting an object, with a container that is open at least on a top side and has a bottom and at least two opposing sidewalls, wherein each of the two opposing sidewalls has at least two pairs of parallel lines of material weakening starting from a free edge, and that the transport packaging comprises at least two tightening straps that are tightened around the container in the areas of the lines of material weakening and penetrate the sidewalls in the areas of the lines of material weakening, wherein the lines of material weakening are perforations, wherein the two pairs of lines of material weakening in each sidewall form two flaps in each sidewall, respective ones of the flaps being pressed inwardly by a respective one of the tightening straps such that each flap is positioned between the object and its respective strap.

2. The transport packaging according to claim 1, wherein the lines of material weakening extend, starting from the free edge, over a length of approximately ⅔ of the height of the sidewalls.

3. The transport packaging according to claim 1, wherein an area of the lines of material weakening directly adjacent to the free edge runs at an angle of approximately 45° to the free edge.

4. The transport packaging according to claim 1, further comprising a cover plate for introduction into the container.

5. The transport packaging according to claim 4, wherein the cover plate has not quite the size of the bottom of the container and is preferably manufactured from a flexible and/or shock-absorbing material.

6. The transport packaging according to claim 1, further comprising a parallelepipedic cover open on one side.

7. The transport packaging according to claim 6, wherein the cover has at least two opposing sidewalls whose height corresponds at least to the length of the material weakening.

* * * * *